US007794277B1

(12) United States Patent
Peng

(10) Patent No.: US 7,794,277 B1
(45) Date of Patent: Sep. 14, 2010

(54) RF CONNECTOR

(75) Inventor: Chang Lin Peng, Jhonghe (TW)

(73) Assignee: F Time Technology Industrial Co., Ltd., Taipei County (TW)

( * ) Notice: Subject to any disclaimer, the term of this patent is extended or adjusted under 35 U.S.C. 154(b) by 0 days.

(21) Appl. No.: 12/487,746

(22) Filed: Jun. 19, 2009

(51) Int. Cl.
*H01R 13/648* (2006.01)

(52) U.S. Cl. ..... 439/607.01

(58) Field of Classification Search ..... 439/620.03, 439/607.01, 620.1, 63, 660
See application file for complete search history.

(56) References Cited

U.S. PATENT DOCUMENTS 5,167,536 A * 12/1992 Wang ..... 439/620.1
5,557,068 A * 9/1996 Chung ..... 174/59
5,613,880 A * 3/1997 Wang ..... 439/620.03
7,695,318 B1 * 4/2010 Wang et al. ..... 439/607.01
2009/0298334 A1 * 12/2009 Takahashi ..... 439/607.01
2010/0003852 A1 * 1/2010 Myer et al. ..... 439/607.17

* cited by examiner

*Primary Examiner*—Jean F Duverne
(74) *Attorney, Agent, or Firm*—Guice Patents PLLC

(57) ABSTRACT

A RF connector having a filter function is disclosed to include an electrically insulative housing, a metal terminal block mounted inside the electrically insulative housing and holding a terminal therein, a plurality of capacitors arranged in the top wall of the electrically insulative housing and having the respective bottom contact ends kept in contact with the top wall of the metal terminal block, and a metal clamp clamped on the electrically insulative housing and pressed on the top contact ends of the capacitors and having two spring arms that are kept in contact with the metal shield of the system casing in which the RF connector is installed.

5 Claims, 6 Drawing Sheets

RF CONNECTOR

BACKGROUND OF THE INVENTION

1. Field of the Invention

The present invention relates to RF connectors and more particularly, to such a RF connector, which provides a filter function to remove noises when installed in a system casing.

2. Description of the Related Art

Following fast development of wireless communication technology, RF signal has been intensively used for data transmission in electronic systems. In a standard design, a RD connector is installed in a system casing, having a connection interface exposed to an opening on the face panel of the system casing for the connection of a connector of a coaxial cable for signal transmission. The face panel is covered with a metal shield for EMI (electromagnetic interference) protection.

A conventional RF connector comprises an electrically insulative housing (made of, for example, plastics), a metal terminal block mounted inside the electrically insulative housing for the connection of a connector of a coaxial cable to provide RF signal. After installation, noises may go out of the electrically insulative housing of the RF connector through the gap in the opening on the face panel to cause interference, or the RF signal may go from the connector of the coaxial cable through the gap in the opening on the face panel inside the inside of the system casing to cause interference (EMI/RPI), lowering signal transmission quality. Accordingly, there is a need for improvement to prevent interference during signal transmission of a RF connector.

SUMMARY OF THE INVENTION

The present invention has been accomplished under the circumstances in view. It is one object of the present invention to provide a RF connector, which provides a filter function to remove noises when installed in a system casing.

To achieve this and other objects of the present invention, a RF connector comprises an electrically insulative housing, a metal terminal block mounted inside the electrically insulative housing and holding a terminal therein, a plurality of capacitors arranged in the top wall of the electrically insulative housing and having the respective bottom contact ends kept in contact with the top wall of the metal terminal block, and a metal clamp clamped on the electrically insulative housing and pressed on the top contact ends of the capacitors and having two spring arms that are kept in contact with the metal shield of the system casing in which the RF connector is installed.

Further, the electrically insulative housing has a clamping ring suspending on the inside; the metal terminal block has a locating groove extending around the periphery of a front cylindrical extension tube thereof and forced into engagement with the clamping ring in the electrically insulative housing.

Further, the electrically insulative housing has two guide rails bilaterally disposed inside an accommodation chamber thereof; the metal terminal block has a guide groove located on each of two opposite lateral sides of a rectangular body thereof and respectively coupled to the guide rails of the electrically insulative housing.

DETAILED DESCRIPTION OF THE PREFERRED EMBODIMENT

Figure 1:
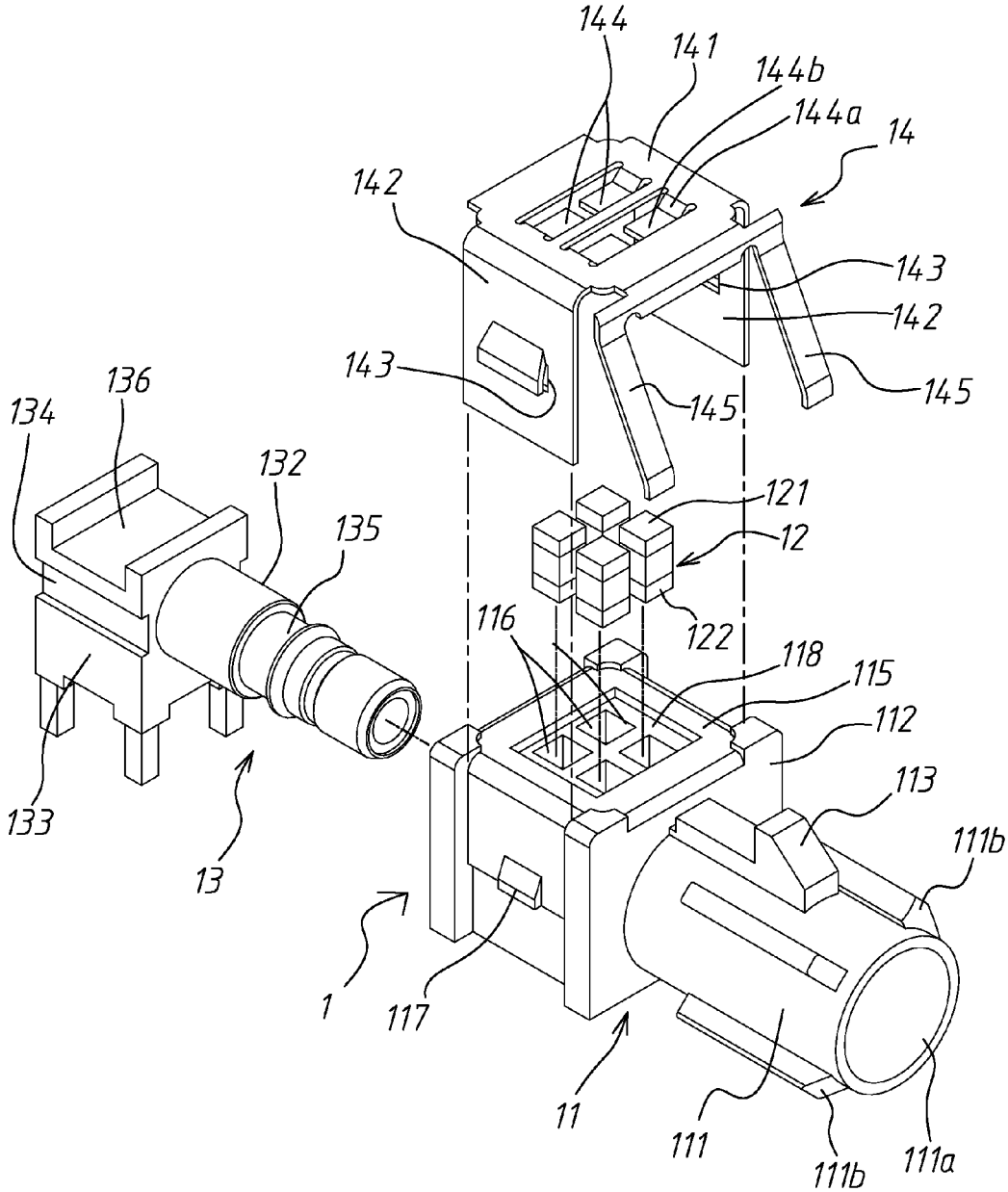
FIG. 1 is an exploded view of a RF connector in accordance with the present invention.
Figure 2:
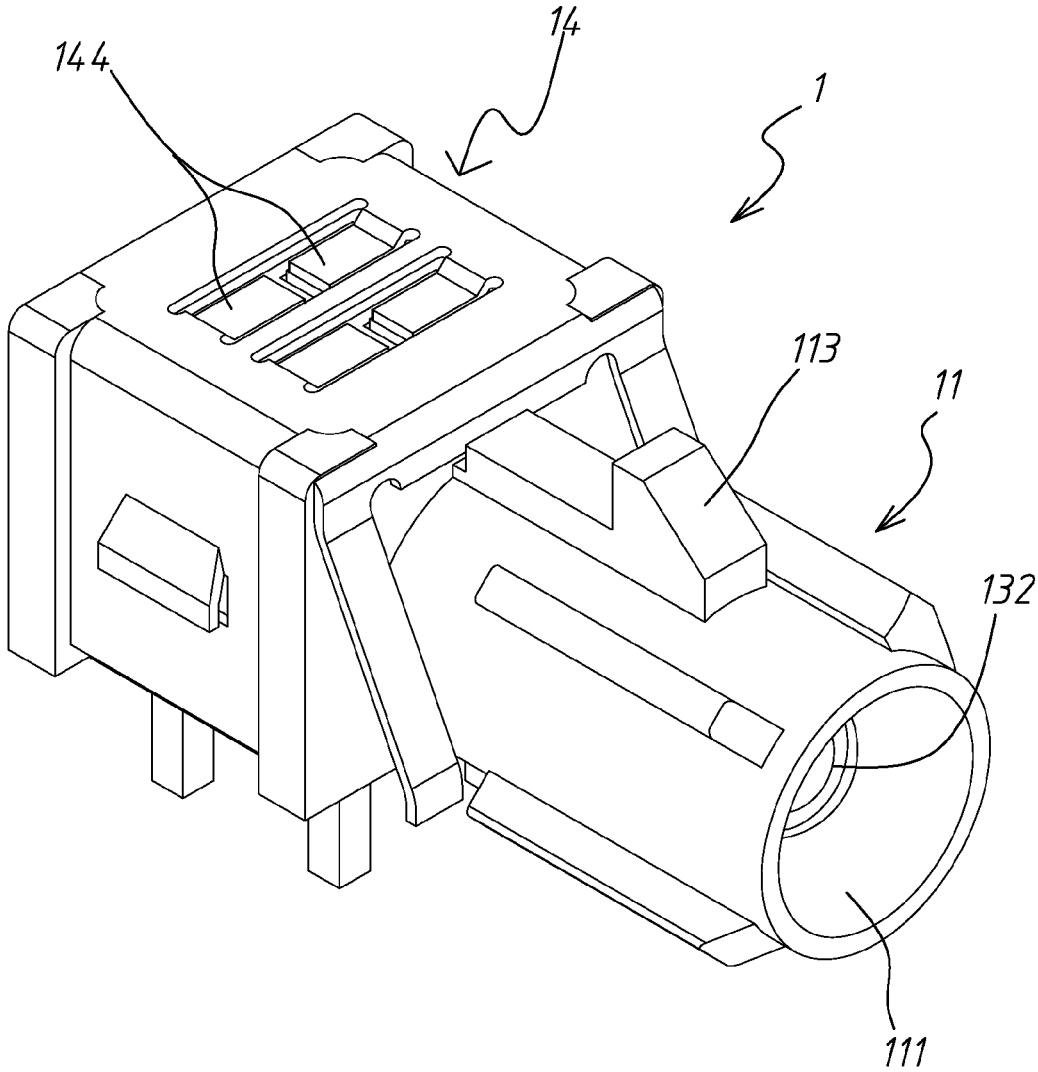
FIG. 2 is an elevational assembly view of the RF connector in accordance with the present invention.

Referring to FIGS. 1~4, a RF connector 1 in accordance with the present invention is shown installed in a system casing having a metal shield, having the connection face thereof exposed to the outside of an opening on the face panel of the system casing. The RF connector 1 comprises an electrically insulative housing 11, a set of capacitors 12, a metal terminal block 13, and a metal clamp 14.

Figure 5:
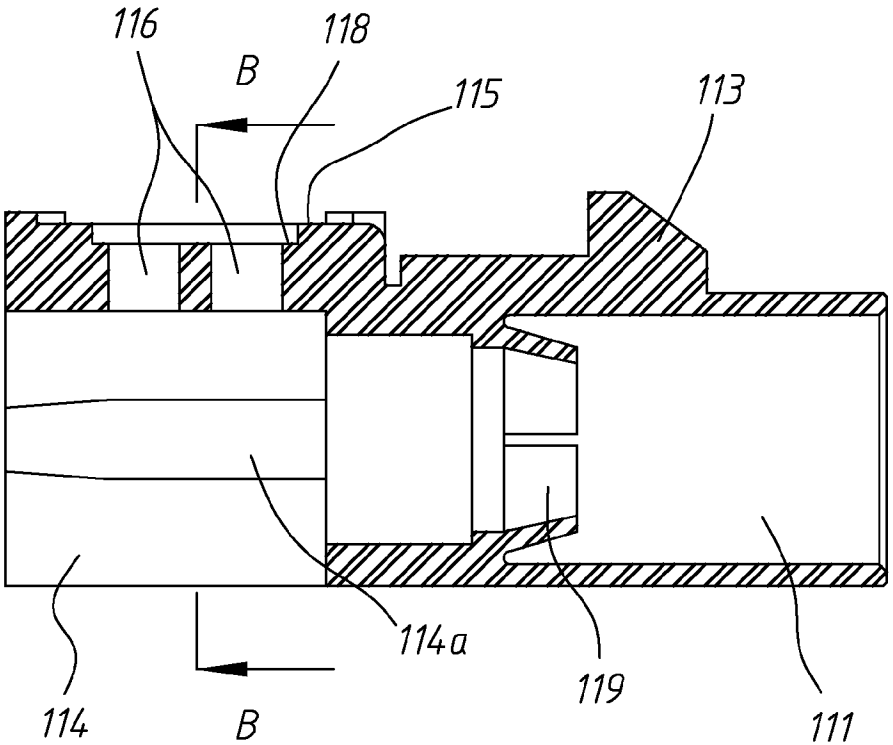
FIG. 5 is a sectional side view of the electrically insulative housing according to the present invention.
Figure 6:
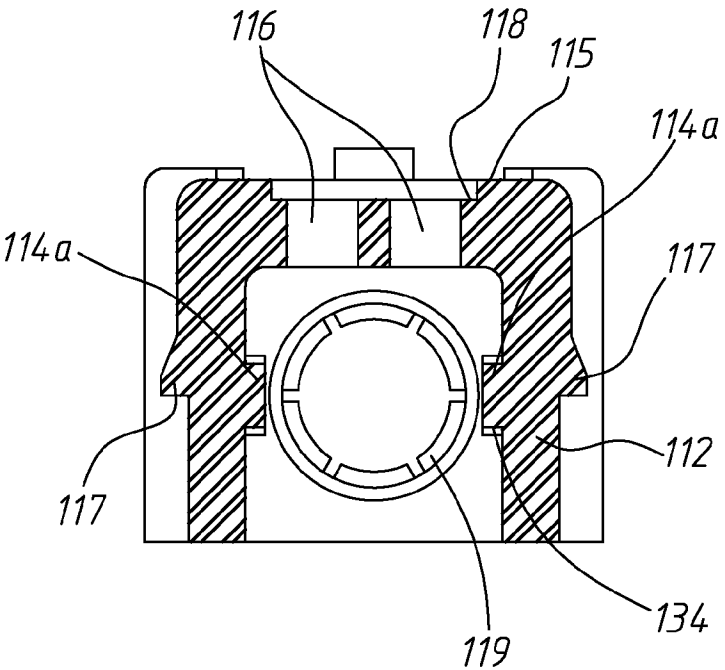
FIG. 6 is a sectional view taken along line B-B of FIG. 5.

The electrically insulative housing 11 has a front cylindrical part 111 and a rear rectangular part 112. The front cylindrical part 111 has a front opening 111*a* axially extending to the inside of the rear rectangular part 112, a clamping ring 119 suspending on the inside (see FIG. 3 or FIG. 5), a hook 113 protruded from the periphery thereof at the top for hooking up with a connector 2 of a coaxial cable 21 (see FIG. 7), a plurality of guide ribs 111*b* protruded from and spaced around the periphery and extending along the length to facilitate connection between the front cylindrical part 111 and the connector 2 of the coaxial cable 21. Referring also to FIGS. 5 and 6, the rear rectangular part 112 of the electrically insulative housing 11 has an accommodation chamber 114 defined therein, two guide rails 114*a* bilaterally disposed inside the accommodation chamber 114, a top recess 118 located on the top wall 115 thereof, a plurality of capacitor holes 116 formed in the top wall 115 and extending downwards from the top recess 118, and a hook block 117 disposed at each of two opposite sidewalls thereof.

Figure 4:
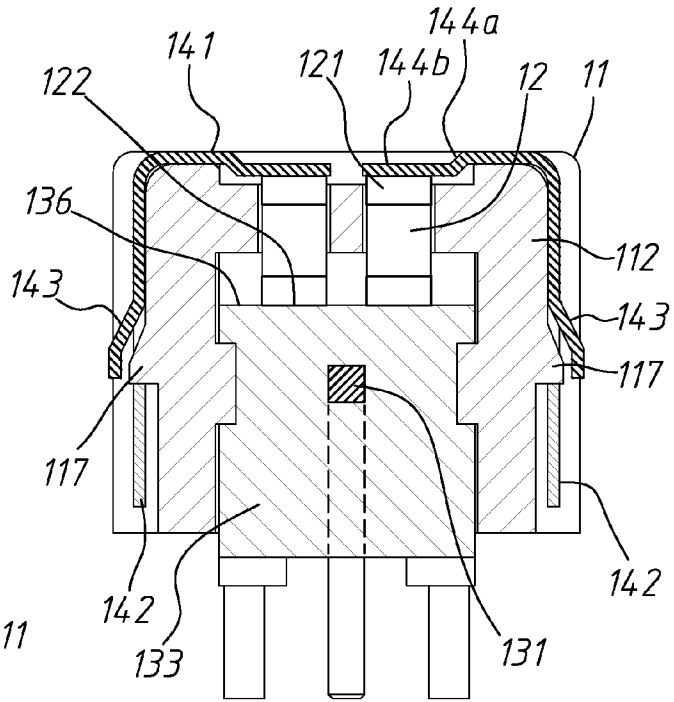
FIG. 4 is a sectional view taken along line A-A of FIG. 3.
Figure 3:
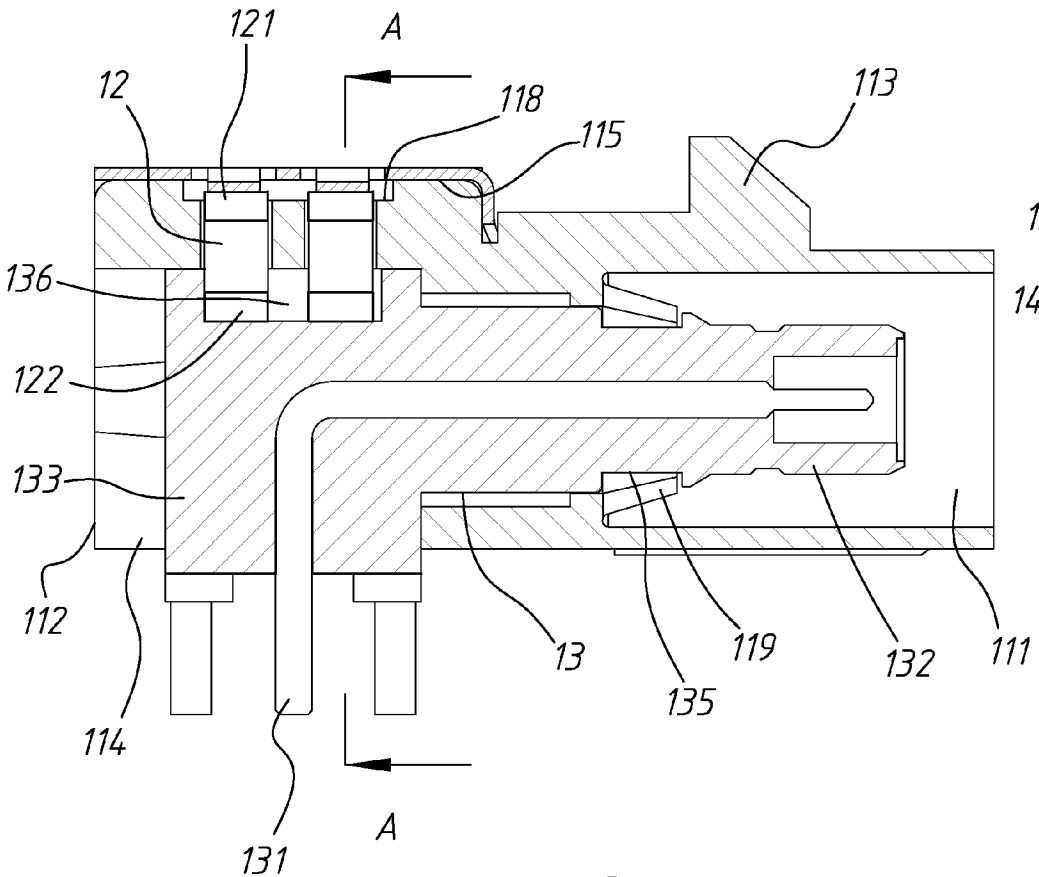
FIG. 3 is a sectional side view of the RF connector in accordance with the present invention.

The capacitors 12 are respectively accommodated in the capacitor holes 116 of the rear rectangular part 112 of the electrically insulative housing 11. Each capacitor 12 has a top contact end 121 kept in proximity to the top wall 115 of the rear rectangular part 112 of the electrically insulative housing 11, and a bottom contact end 122 suspending in the accommodation chamber 114, as shown in FIG. 3 or FIG. 4.

The metal terminal block 13 holds a terminal 131 on the inside, having a rectangular body 133 disposed at the rear side and a cylindrical extension tube 132 forwardly extended from the rectangular body 133. The cylindrical extension tube 132 is inserted into the rear rectangular part 112 of the electrically insulative housing 11 into the inside of the front cylindrical part 111, enabling the rectangular body 133 to be accommodated in the accommodation chamber 114 inside the rear rectangular part 112 of the electrically insulative housing 11. The rectangular body 133 has a top wall 136 kept in contact with the bottom contact ends 122 of the capacitors 12, and a guide groove 134 located on each of the two opposite lateral sides thereof and respectively coupled to the guide rails 114*a* in the rear rectangular part 112 of the electrically insulative housing 11. The cylindrical extension tube 132 has a locating groove 125 extending around the periphery and forced into engagement with the clamping ring 119 in the front cylindrical part 111 of the electrically insulative housing 11.

The metal clamp 14 has a top panel 141 covered on the top wall 115 of the rear rectangular part 112 of the electrically insulative housing 11, two side panels 142 respectively extended from two opposite sides of the top panel 141 and respectively covered on the two opposite sidewalls of the rear rectangular part 112 of the electrically insulative housing 11, a punch hole 143 located on each of the two side panels 142 and respectively forced into engagement with the hook block 117 of the rear rectangular part 112 of the electrically insulative housing 11, a plurality of springy contact strips 144 protruded from the top panel 141 and respectively pressed on the top contact ends 121 of the capacitors 12, two springy arms 145 bilaterally downwardly extended from the front side of the top panel 141. After installation of the RF connector 1 in the system casing, the springy arms 145 have the respective bottom ends kept in contact with the metal shield 3 of the system casing (see FIG. 7). Further, each springy contact strip 144 has a connection portion 144*a* obliquely extended from the top panel 141 of the metal clamp 14, and a contact portion 144*b* horizontally extended from the connection portion 144*a* and suspending at an elevation below the top recess 118 of the electrically insulative housing 11 for compressively contacting the top contact end 121 of the corresponding capacitor 12, as shown in FIGS. 3 and 4).

Figure 7:
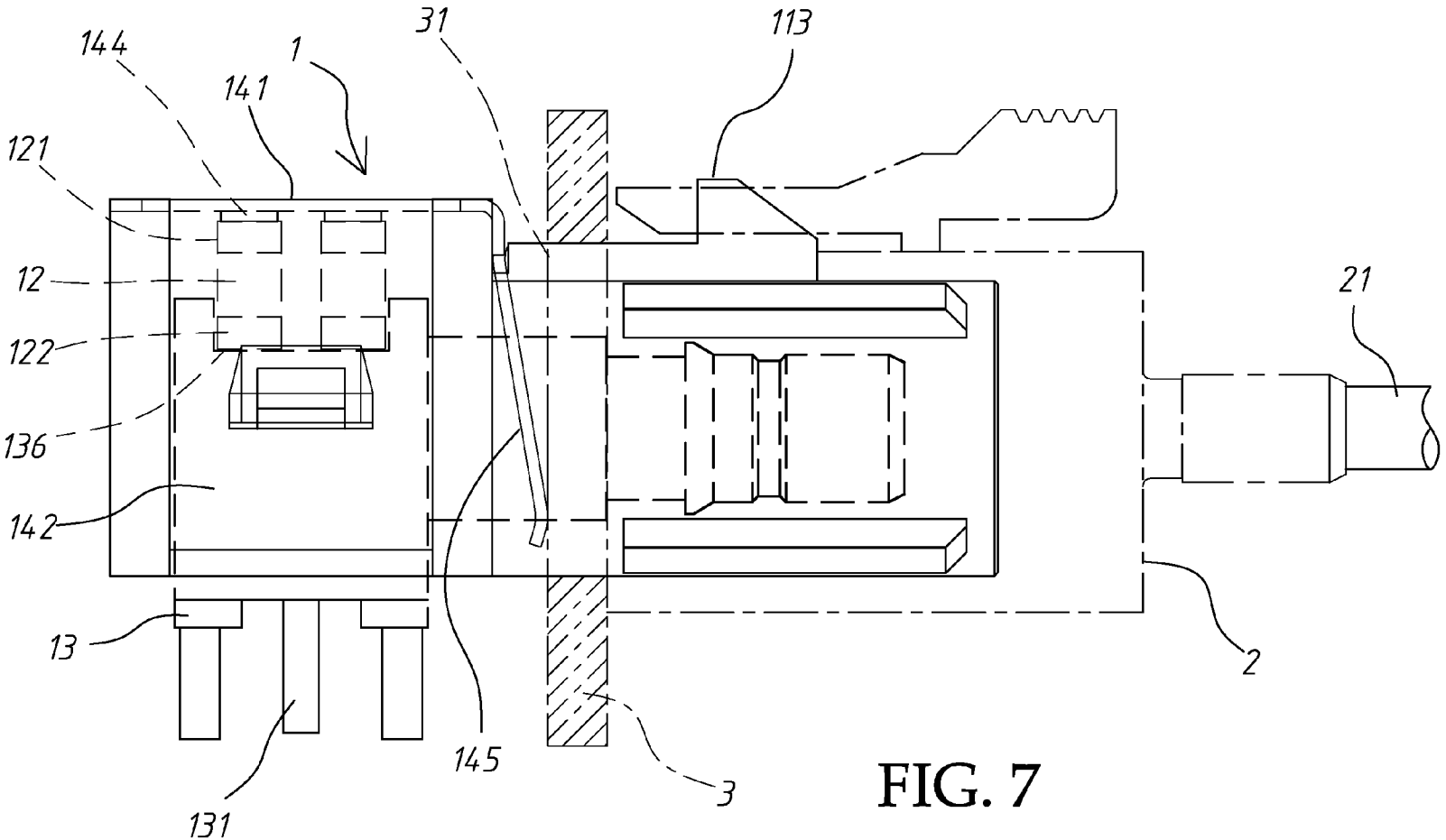
FIG. 7 is a schematic sectional view of the present invention, showing the RF connector connected with a connector of a coaxial cable.

Referring to FIG. 7, after installation of the RF connector 1 in the system casing inside the opening 31 of the metal shield 3, the connector 2 of the coaxial cable 21 is connected to the RF connector 1 to generate an RF signal. At this time, the top contact ends 121 and bottom contact ends 122 of the capacitors 12 are respectively kept in contact with the springy contact strips 144 of the metal clamp 14 and the top wall 136 of the metal terminal block 13, and the springy arms 145 of the metal clamp 14 are kept in contact with the metal shield 3 of the system casing, and therefore the RF connector 1 removes system internal noises as well as outside noises, assuring high level signal transmission.

Figure 8:
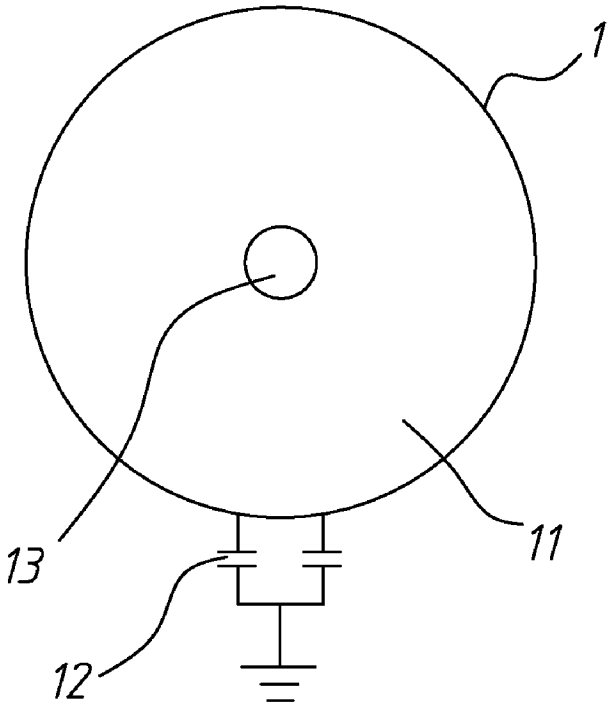
FIG. 8 is a schematic circuit diagram of the present invention, showing two capacitors used in the RF connector.
Figure 9:
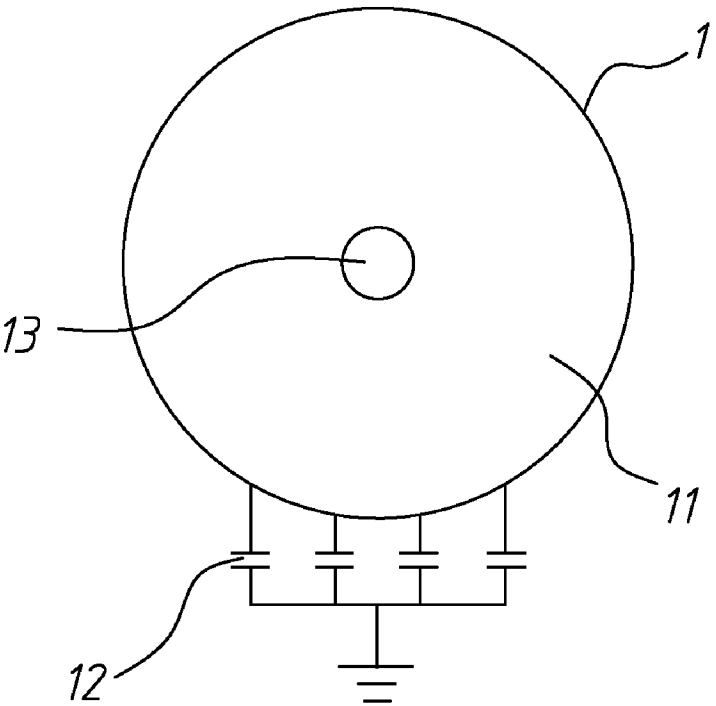
FIG. 9 is a schematic circuit diagram of the present invention, showing four capacitors used in the RF connector.

According to the present preferred embodiment, the number of the capacitors 12 is 4. However, this is not a limitation. Two capacitors can be used, achieving same effects. FIG. 8 illustrates two capacitors 12 used and grounded through the metal clamp 14 and the system casing to provide a filter function to the center of the metal terminal block 13. FIG. 9 illustrates four capacitors 12 used and grounded through the metal clamp 14 and the system casing.

Although a particular embodiment of the invention has been described in detail for purposes of illustration, various modifications and enhancements may be made without departing from the spirit and scope of the invention. Accordingly, the invention is not to be limited except as by the appended claims.

What the invention claimed is:

1. A RF connector installed in a system casing having a metal shield and exposed to the outside of an opening on a face panel of said system casing, the RF connector comprising:

an electrically insulative housing, said electrically insulative housing having a front cylindrical part and a rear rectangular part, said front cylindrical part having a front opening axially extending therethrough to the inside of said rear rectangular part, a hook protruded from the periphery at a top side thereof for hooking up with a connector of a coaxial cable, said rear rectangular part having an accommodation chamber defined therein, a plurality of capacitor holes formed in a top wall thereof and a hook block disposed at each of two opposite sidewalls thereof;

a plurality of capacitors respectively accommodated in said capacitor holes of said rear rectangular part of said electrically insulative housing, each said capacitor having a top contact end kept in proximity to the top wall of said rear rectangular part of said electrically insulative housing, and a bottom contact end suspending in said accommodation chamber;

a metal terminal block holding a terminal on the inside thereof, said metal terminal block having a rectangular body disposed at the rear side and positioned in said accommodation chamber inside said rear rectangular part of said electrically insulative housing and a cylindrical extension tube forwardly extended from said rectangular body and positioned in said front cylindrical part of said electrically insulative housing, said rectangular body having a top wall kept in contact with the bottom contact ends of said capacitors;

a metal clamp clamped on said rear rectangular part of said electrically insulative housing, said metal clamp having a top panel covered on the top wall of said rear rectangular part of said electrically insulative housing, a punch hole located on each of two opposite side panels thereof and respectively forced into engagement with the hook blocks of said rear rectangular part of said electrically insulative housing, a plurality of springy contact strips protruded from said top panel and respectively pressed on the top contact ends of said capacitors and two springy arms bilaterally downwardly extended from a front side of said top panel for contacting the metal shield of the system casing in which the RF connector is installed.

2. The RF connector as claimed in claim 1, wherein said rear rectangular part of said electrically insulative housing has a top recess located on the top wall thereof; said capacitor holes extend vertically downwardly from said top recess; each springy contact strip of said metal clamp a connection portion obliquely extended from the top panel of said metal clamp and a contact portion horizontally extended from said connection portion and suspending at an elevation below said top recess of said electrically insulative housing and compressively pressed on the top contact end of the associating capacitor.

3. The RF connector as claimed in claim 1, wherein said front cylindrical part of said electrically insulative housing has a clamping ring suspending on the inside; said cylindrical extension tube of said metal terminal block has a locating groove extending around the periphery thereof and forced into engagement with said clamping ring in said front cylindrical part of said electrically insulative housing.

4. The RF connector as claimed in claim 1, wherein said front cylindrical part of said electrically insulative housing has a plurality of longitudinal guide ribs protruded from and spaced around the periphery thereof.

5. The RF connector as claimed in claim 1, wherein said rear rectangular part of said electrically insulative housing has two guide rails bilaterally disposed inside said accommodation chamber; said rectangular body has a guide groove located on each of two opposite lateral sides thereof and respectively coupled to the guide rails of said rear rectangular part of said electrically insulative housing.

* * * * *